United States Patent [19]

Gladd et al.

[11] 4,452,501

[45] Jun. 5, 1984

[54] ELECTRICAL CONNECTOR WITH LATCH TERMINAL

[75] Inventors: Joseph H. Gladd, Cortland; Robert G. Plyler, Vienna; Lyle B. Suverison, Fowler, all of Ohio

[73] Assignee: General Motors Corporation, Detroit, Mich.

[21] Appl. No.: 373,408

[22] Filed: Apr. 30, 1982

[51] Int. Cl.[3] ..... H01R 13/639

[52] U.S. Cl. ..... 339/91 R; 339/97 R; 339/113 R

[58] Field of Search ..... 339/91 R, 97 R, 97 P, 339/113 R

[56] References Cited

U.S. PATENT DOCUMENTS

| | | | |
|---|---|---|---|
| 3,544,951 | 12/1970 | Roberts | 339/91 R |
| 3,605,072 | 9/1971 | Driscoll | 339/98 |
| 3,611,261 | 10/1971 | Gregory | 339/91 R |
| 3,750,092 | 7/1973 | Bury | 339/91 R |
| 3,803,533 | 4/1974 | Taplin | 339/91 R |
| 4,037,905 | 7/1977 | Lucas | 339/98 |
| 4,072,387 | 2/1978 | Sochor | 339/91 R |
| 4,178,051 | 12/1979 | Kocher et al. | 339/45 M |

FOREIGN PATENT DOCUMENTS

| | | |
|---|---|---|
| 0040941 | 12/1981 | European Pat. Off. . |
| 2296951 | 7/1976 | France . |

*Primary Examiner*—John McQuade

*Attorney, Agent, or Firm*—F. J. Fodale

[57] ABSTRACT

An electrical connector comprises a pair of mating dielectric connector bodies each having a plurality of electrical contacts which engage the electrical contacts of the other when the connector bodies are coupled. The coupled connector bodies are locked together by a projection on one connector body and a cooperating lock arm which is part of a resilient metal clip which is attached to the other connector body and which engages an electrical contact on the one connector body when the coupled connector bodies are locked together. The resilient metal clip has a central slot for attaching a conductor to the clip and for disengaging the lock arm with a screwdriver or the like.

3 Claims, 3 Drawing Figures

ELECTRICAL CONNECTOR WITH LATCH TERMINAL

This invention relates generally to electrical connectors comprising coupled, dielectric connector bodies and, more particularly, to electrical connectors in which the dielectric connector bodies have cooperating lock members and electrical contacts associated with the lock members which engage when the connector bodies are properly coupled and locked together.

U.S. Pat. No. 3,611,261 granted to Kenneth Lawrence Gregory on Oct. 5, 1981 discloses an electrical connector of the above noted type. In this prior art electrical connector, the dielectric connector bodies 48 and 50, when properly coupled, are locked together by a barb 58 on a flexible wall portion 60 of the connector body 48 which enters an aperture 78 in a lug 76 formed on the connector body 50. Electrical contacts 62 and 82, crimped onto the ends of insulated conductors, are secured to the respective connector bodies 48 and 50 adjacent the barb 58 and the aperture 72. These electrical contacts engage only when the dielectric connector bodies are properly coupled and locked together. This arrangement affords a simple method of ensuring that the dielectric connector bodies 48 and 50 are properly united as electrical continuity is not achieved until the dielectric connector bodies 48 and 50 are properly united.

The object of this invention is to provide an improved lock and electrical contact arrangement for ensuring that dielectric connector bodies are properly united.

An important feature of the invention is the use of a resilient metal clip which serves as a lock member as well as an electrical contact. This eliminates the need for precisely positioning the electrical contact with respect to its associated lock member and also provides greater freedom in choosing the material of the dielectric connector bodies since a flexible portion of one connector body is no longer required.

Another feature of the invention is that the resilient metal clip facilitates attachment of an insulated conductor since it is easily adapted for an insulation displacement connection.

Another feature of the invention is that the connector bodies are easily unlocked since the resilient metal clip can be lifted by a handy tool, such as a screwdriver.

Other objects and features of the invention will become apparent to those skilled in the art as the disclosure is made in the following detailed description of a preferred embodiment of the invention as illustrated in the accompanying sheet of drawing in which.

Figure 1:
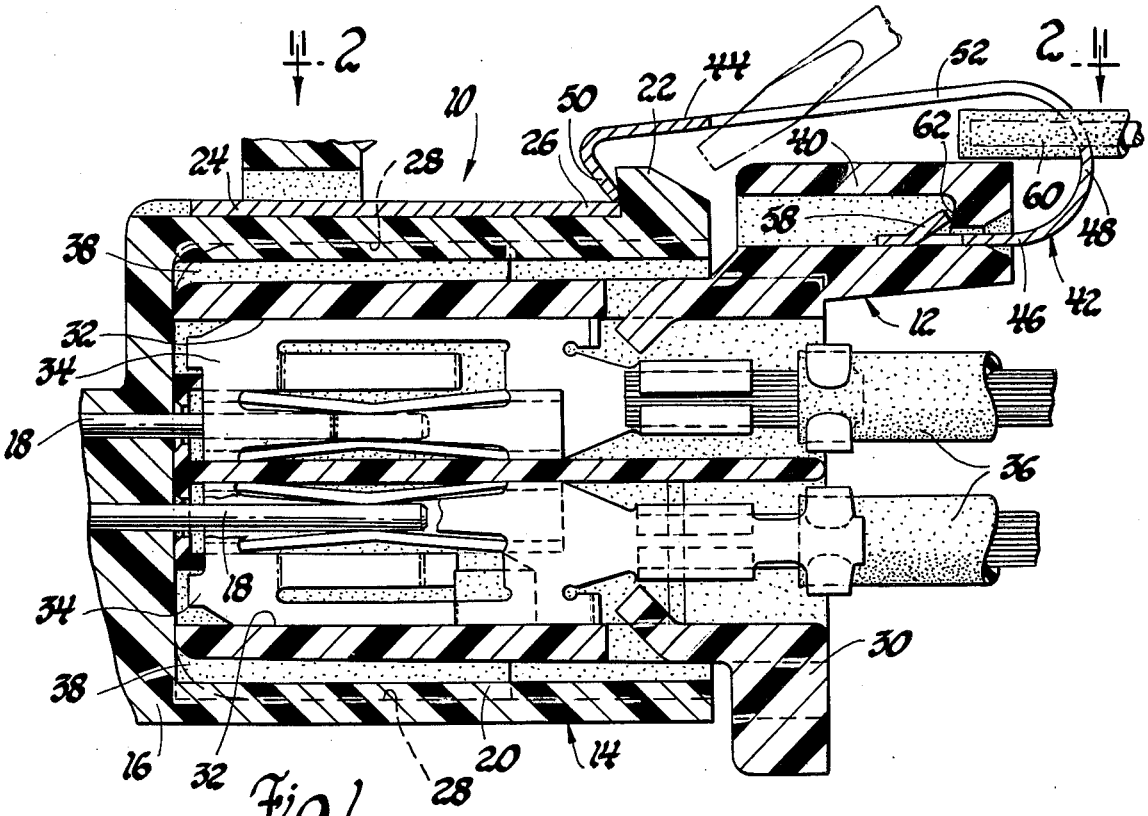
FIG. 1 is a longitudinal section of an electrical connector in accordance with this invention.
Figure 2:
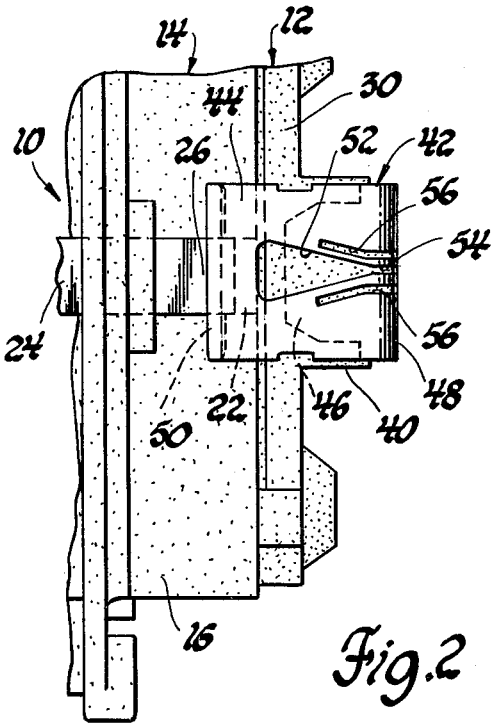
FIG. 2 is a fragmentary top view of the electrical connector taken substantially along the line 2—2 of FIG. 1 looking in the direction of the arrows.
Figure 3:
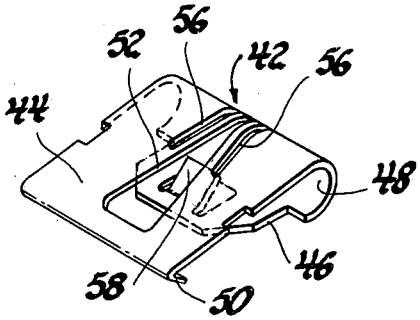
FIG. 3 is a perspective view of the resilient metal clip shown in FIGS. 1 and 2.

Referring now to the drawing, FIGS. 1 and 2, an electrical connector 10 comprises mating plug and socket connectors 12 and 14 coupled and locked together.

The socket connector 14 is a header for a printed circuit board (not shown) and comprises a dielectric connector body 16 and two rows of pin terminals 18 which protrude into a socket portion 20 of the connector body 16. The socket portion 20 has an external barb or lock projection 22 at the mating end of the connector body 16 and a flat conductive strip 24 is attached to the outside of the socket portion 20 to provide an electrical contact 26 immediately behind the lock projection 22. The flat conductive strip may be attached in any suitable manner. The socket portion 20 has internal grooves 28 which are situated so that the plug connector 12 fits into the socket portion 20 only one way.

The plug connector 12 comprises a dielectric connector body 30 having two rows of terminal cavities 32 which house female terminals 34 attached to insulated conductors 36. The connector body 30 has external ribs 38 which cooperate with the grooves 28 to assure that the connector body 30 is plugged into the socket portion 20 in the proper orientation as indicated above. The plug connector 12 and female terminals 34 are described in detail in U.S. patent application Ser. No. 359,686, filed by Joseph H. Gladd et al on Mar. 19, 1982. However, a more detailed description is not necessary to an understanding of this invention, other than to point out that each of the pin terminals 18 enter a terminal cavity 32 and contact the female terminal 34 therein when the plug and socket connectors 12 and 14 are coupled as shown in FIG. 1.

The connector body 30 has an integral hollow boss 40 at the conductor end for attaching a resilient metal clip 42 to the connector body 30.

The clip 42 is preferably made of stainless steel and comprises an elongated lock arm 44 and a short mounting tab 46 integrally connected to each other at one end by a round bend 48 of approximately 180°.

The lock arm 44 has a hook 50 at its free end and a central, close-ended slot 52 which starts rearwardly of the hook 50 and ends approximately halfway round the bend 48. The end of the slot 52 near the hook 50 is wide and the slot 52 converges as it approaches the bend 48 where the slot 52 narrows to an insulation piercing portion 54 of constant width. An insulated conductor may easily be attached to the clip 42 by the well-known insulation piercing method simply by inserting the end of an insulated conductor 60 into the wide end of the slot 52 and pushing or pulling the insulated conductor 60 along the slot 52 until it is disposed snuggly in the insulation piercing portion 54 where the clip contacts and conductor core as shown in FIG. 1. The shape of the slot 52 also facilitates unlocking the lock arm 44 as explained later.

The lock arm 44 and bend 48 also have narrow close-ended slots 56 on either side of the central slot 52. These slots increase the flexibility of clip portions defining the central slot 52 particularly the insulation piercing portion 54. The increased flexibility decreases the force required to pull or push the conductor 60 into the insulation piercing portion 54 and also provides a better grip on the conductor 60 once it is deep in the insulation piercing portion 54.

The clip 42 is attached to the connector body 30 by inserting the tab 46 into the boss 40 until a latch tang 58 formed from the tab engages an internal shoulder 62 in the boss 40.

When the connector body 30 is plugged into the socket portion 20, the hook 50 rides over and snaps behind the lock projection 22 simultaneously locking the connector bodies 16 and 30 together and engaging electrical contact 26. The clip 42 thus locks the connector bodies 16 and 30 together and also indicates the connector bodies 16 and 30 are properly united when the contact strip 24 and the clip 42 are subjected to an electrical continuity test.

The connector bodies 16 and 30 can be unlocked easily, simply by inserting the end of a screwdriver in the wide end of the slot 52 as shown in FIG. 1 and pressing down on the handle to lift the hook 50 over the projection 22.

It should be noted that the insulated conductor 60 is attached to the bend portion 48 of the clip 42 so that the use of a screwdriver or the like to lift the hook 50 does not interfere with the connection between the clip 42 and the insulated conductor 60.

We wish it to be understood that we do not desire to be limited to the exact details of construction shown and described for obvious modifications will occur to a person skilled in the art.

The embodiments of the invention in which an exclusive property or privilege is claimed are defined as follows:

1. An electrical connector comprising:

a pair of mating dielectric connector bodies, a plurality of electrical contacts in each connector body which engage the electrical contacts in the other connector body when the connector bodies are coupled, a projection on one connector body and a cooperating lock arm on the other connector body having a hook at a free end thereof engaging the projection to lock the coupled connector bodies together, an electrical contact on the one connector body immediately behind the projection which is engaged by the hook when it engages the projection, and a resilient metal clip which includes said lock arm and a tab connected to the lock arm, said resilient metal clip being attached to the other connector body by the tab and having a central slot beginning rearwardly of the hook for attaching a conductor to the clip.

2. An electrical connector comprising:

a pair of mating dielectric connector bodies, a plurality of electrical contacts in each connector body which engage the electrical contacts in the other connector body when the connector bodies are coupled, a projection on one connector body and a cooperating elongated lock arm on the other connector body having a hook at a free end thereof engaging the projection to lock the coupled connector bodies together, an electrical contact on the one connector body immediately behind the projection which is engaged by the hook when it engages the projection, and a resilient metal clip which includes said lock arm and a tab connected to the lock arm by a round bend of approximately 180°, said resilient metal clip being attached to the other connector body by the tab and having a central slot beginning rearwardly of the hook and ending in the bend for attaching a conductor to the clip.

3. An electrical connector comprising:

a pair of mating dielectric connector bodies, a plurality of electrical contacts in each connector body which engage the electrical contacts in the other connector body when the connector bodies are coupled, a projection on one connector body and a cooperating elongated lock arm on the other connector body having a hook at a free end thereof engaging the projection to lock the coupled connector bodies together, a conductive strip mounted on the one connector body to provide an electrical contact immediately behind the projection which is engaged by the hook when it engages the projection, and a resilient metal clip which includes said lock arm and a tab connected to the lock arm by a round bend of approximately 180°, said resilient metal clip being attached to the other connector body by the tab and having a central close-ended slot beginning rearwardly of the hook and ending in the bend for attaching a conductor to the clip, said central slot having a wide end near the hook and converging toward the bend into a narrow insulation piercing portion which extends approximately half-way round the bend.

* * * * *